US010170047B2

(12) United States Patent
Park

(10) Patent No.: US 10,170,047 B2
(45) **Date of Patent: *Jan. 1, 2019**

(54) ORGANIC LIGHT EMITTING DISPLAY AND DRIVING METHOD THEREOF

(71) Applicant: Samsung Display Co., Ltd., Yongin-si, Gyeonggi-do (KR)

(72) Inventor: Sung-Cheon Park, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 81 days.

This patent is subject to a terminal disclaimer.

(21) Appl. No.: 15/236,168

(22) Filed: Aug. 12, 2016

(65) Prior Publication Data

US 2017/0039951 A1 Feb. 9, 2017

Related U.S. Application Data

(63) Continuation of application No. 14/165,234, filed on Jan. 27, 2014, now Pat. No. 9,424,774.

(30) Foreign Application Priority Data

Jul. 5, 2013 (KR) ..... 10-2013-0078908

(51) Int. Cl.
*G09G 5/00* (2006.01)
*G09G 3/3258* (2016.01)
(Continued)

(52) U.S. Cl.
CPC ..... *G09G 3/3258* (2013.01); *G09G 3/3233* (2013.01); *G09G 3/3266* (2013.01);
(Continued)

(58) Field of Classification Search
CPC .. G09G 3/3258; G09G 3/3266; G09G 3/3291; G09G 3/3233; G09G 2330/028; G09G 2300/0866
See application file for complete search history.

(56) References Cited

U.S. PATENT DOCUMENTS

2009/0021230 A1 1/2009 Han et al.
2011/0043507 A1 2/2011 Yang
(Continued)

FOREIGN PATENT DOCUMENTS

KR 10-2007-0109165 A 11/2007
KR 10-2009-0009395 A 1/2009
KR 10-2010-0007171 A 1/2010

*Primary Examiner* — Adam R. Giesy
(74) *Attorney, Agent, or Firm* — Lewis Roca Rothgerber Christie LLP

(57) ABSTRACT

An organic light emitting display includes a plurality of pixels coupled to scan and data lines; a scan driver configured to supply a scan signal to the pixels through the scan lines; a data driver configured to supply a data signal to the pixels through the data lines; and a power supplier configured to supply first and second voltages to the pixels and a third voltage to at least one of the scan and the data driver, wherein the power supplier includes a first converter configured to convert an input voltage into the first voltage, a second converter configured to convert the input voltage into the second voltage, a third converter configured to receive the first voltage and convert the received first voltage into the third voltage, and a shutdown switch configured to control whether or not the first voltage generated by the first converter is supplied to the pixels.

12 Claims, 5 Drawing Sheets

(51) Int. Cl.
*G09G 3/3233* (2016.01)
*G09G 3/3266* (2016.01)
*G09G 3/3291* (2016.01)

(52) U.S. Cl.
CPC ... *G09G 3/3291* (2013.01); *G09G 2300/0866* (2013.01); *G09G 2330/028* (2013.01)

(56) References Cited

U.S. PATENT DOCUMENTS

2011/0289335 A1* 11/2011 Lipiansky ..... G06F 1/26
713/340
2014/0320472 A1 10/2014 Uchino et al.

* cited by examiner

ORGANIC LIGHT EMITTING DISPLAY AND DRIVING METHOD THEREOF

CROSS-REFERENCE TO RELATED APPLICATION

This application is a continuation of U.S. patent application Ser. No. 14/165,234, filed Jan. 27, 2014, which claims priority to and the benefit of Korean Patent Application No. 10-2013-0078908, filed on Jul. 5, 2013, the entire contents of both of which are incorporated herein by reference.

BACKGROUND

1. Field

Embodiment of the present invention relate to an organic light emitting display and a driving method thereof.

2. Description of the Related Art

Flat panel displays include liquid crystal displays, field emission displays, plasma display panels, organic light emitting displays, and the like.

Among these flat panel displays, the organic light emitting display displays images using organic light emitting diodes that emit light through recombination of electrons and holes. The organic light emitting display has a fast response speed and is driven with low power consumption.

SUMMARY

According to an embodiment of the present invention, there is provided an organic light emitting display including: a plurality of pixels coupled to scan lines and data lines; a scan driver configured to supply a scan signal to the pixels through the scan lines; a data driver configured to supply a data signal to the pixels through the data lines; and a power supplier configured to supply first and second voltages to the pixels and to supply a third voltage to at least one of the scan driver and the data driver, wherein the power supplier includes a first converter configured to convert an input voltage into the first voltage, a second converter configured to convert the input voltage into the second voltage, a third converter configured to receive the first voltage generated by the first converter and convert the received first voltage into the third voltage, and a shutdown switch configured to control whether or not the first voltage generated by the first converter is supplied to the pixels.

Driving of the first and third converters may be controlled by a first control signal.

When the first and third converters are driven corresponding to the first control signal, driving of the third converter may be started after that of the first converter.

On-off operations of the shutdown switch may be controlled by a second control signal.

Driving of the second converter may be controlled by the second control signal.

The pixels may display black during a period when a level of the second voltage output from the second converter is changed.

The pixels may display black during a period when the shutdown switch is turned on and when the shutdown switch is turned off.

The pixels may perform a normal emission operation within a period in which the shutdown switch is maintained in a turn-on state.

The first voltage may be a positive voltage, and the second voltage may be a negative voltage.

The third voltage may have a level higher than that of the first voltage.

According to another embodiment of the present invention, there is provided a method of driving an organic light emitting display, the method including: converting an input voltage into a first voltage by driving a first converter and converting the first voltage into a third voltage by driving a third converter, thereby supplying the converted third voltage to at least one of a scan driver and a data driver during a first period; and turning on a shutdown switch to supply the first voltage generated in the first converter to pixels, and driving a second converter to convert the input voltage into a second voltage and to supply the converted second voltage to the pixels during a second period.

The method may further include turning off the shutdown switch to block the voltage generated by the first converter from being supplied to the pixels and to stop the driving of the second converter during a third period.

The method may further include stopping the driving of the first and third converters during a fourth period.

The pixels may display black during a period when the shutdown switch is turned on and when the shutdown switch is turned off.

The shutdown switch may be turned off during the first period, thereby blocking the first voltage generated by the first converter from being supplied to the pixels.

The driving of the third converter may be started after that of the first converter.

The pixels may display black during a period in which a level of the second voltage output from the second converter is changed.

The pixels may perform a normal emission operation within a period in which the shutdown switch is in a turn-on state.

The first voltage may be a positive voltage, and the second voltage may be a negative voltage.

The third voltage may have a level higher than that of the first voltage.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. It will be understood that when an element is referred to as being "between" two elements, it may be the only element between the two elements, or one or more intervening elements may also be present. Like reference numerals refer to like elements throughout.

DETAILED DESCRIPTION

Figure 1:
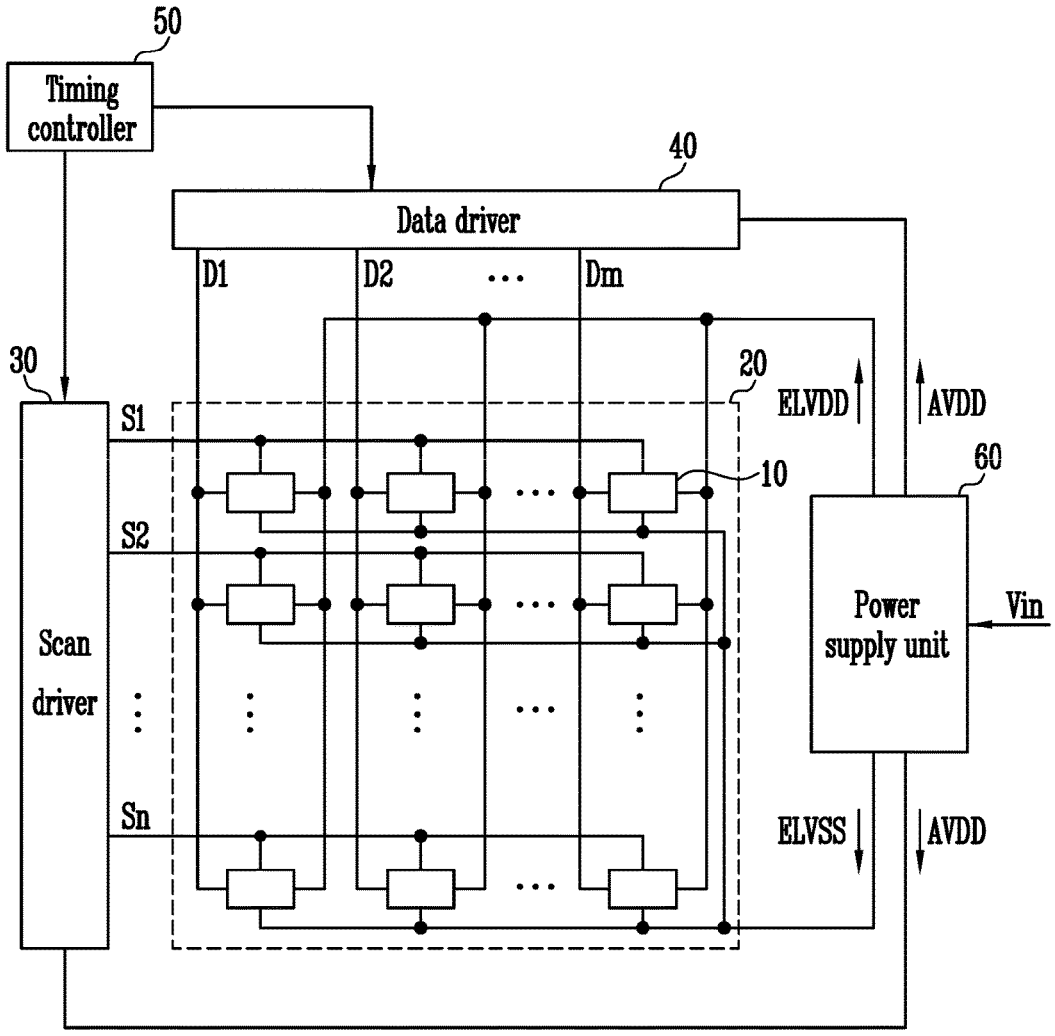
FIG. 1 is a block diagram illustrating an organic light emitting display according to an embodiment of the present invention.

Hereinafter, certain exemplary embodiments according to the present invention will be described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the invention are omitted for clarity. Expressions such as "at least one of," when preceding a list of elements, modify the entire list of elements and do not modify the individual elements of the list. Also, like reference numerals refer to like elements throughout.

FIG. 1 is a block diagram illustrating an organic light emitting display according to an embodiment of the present invention.

Referring to FIG. 1, the organic light emitting display according to this embodiment may include a display unit 20 including a plurality of pixels 10 coupled to scan lines S1 to Sn and data lines D1 to Dm, a scan driver 30 configured to supply a scan signal to the pixels 10 through the scan lines S1 to Sn, a data driver 40 configured to supply a data signal to the pixels 10 through the data lines D1 to Dm, and a power supply unit (or power supplier) 60 configured to supply a first voltage ELVDD, a second voltage ELVSS and a third voltage AVDD.

The organic light emitting display may further include a timing controller 50 configured to control the scan driver 30 and the data driver 40.

Each pixel 10 receiving the first and second voltages ELVDD and ELVSS supplied from the power supply unit 60 generates light corresponding to a data signal when a current flows from the first voltage ELVDD to the second voltage ELVSS via an organic light emitting diode.

The scan driver 30 generates a scan signal under the control of the timing controller 50, and supplies the generated scan signal to the scan lines S1 to Sn.

The data driver 40 generates a data signal under the control of the timing controller 50, and supplies the generated data signal to the data lines D1 to Dm.

When the scan signal is progressively (e.g., sequentially) supplied to the scan lines S1 to Sn, pixels 10 are progressively (e.g., sequentially) selected for each line, and the selected pixels 10 receive the data signal supplied from the data lines D1 to Dm.

The power supply unit 60 supplies the first and second voltages ELVDD and ELVSS to each pixel 10.

The power supply unit 60 generates a driving voltage for the scan driver 30 and the data driver 40, and supplies the generated driving voltage to the scan driver 30 and the data driver 40.

For example, the power supply unit 60 may supply the third voltage AVDD to at least one of the scan driver 30 and the data driver 40.

The power supply unit 60 receives an input voltage Vin supplied from the outside of the organic light emitting display, and generates the first, second and third voltages ELVDD, ELVSS and AVDD, respectively, using the input voltage Vin.

In this case, the first voltage ELVDD may be a positive voltage (e.g., set as a positive voltage), and the second voltage ELVSS may be a negative voltage (e.g., set as a negative voltage).

The third voltage AVDD may have a voltage level higher than that of the first voltage ELVDD.

The input voltage Vin may be provided from a battery that provides a DC voltage or a rectifying device that converts an AC voltage into a DC voltage and outputs the converted DC voltage.

Figure 2:
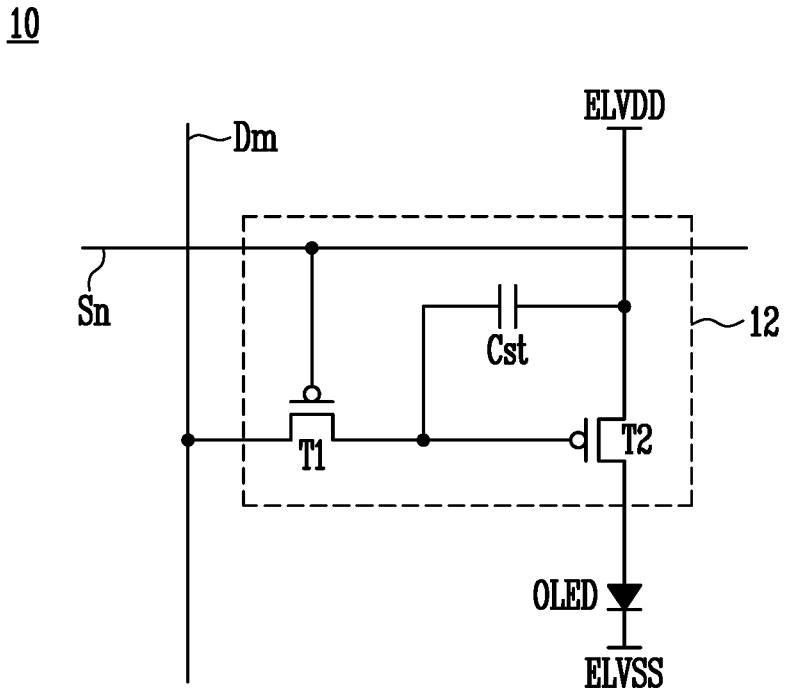
FIG. 2 is a circuit diagram illustrating an example embodiment of the pixel shown in FIG. 1.

FIG. 2 is a circuit diagram illustrating an example embodiment of the pixel shown in FIG. 1. Particularly, for convenience of illustration, a pixel coupled to an n-th scan line Sn and an m-th data line Dm is shown in FIG. 2.

Referring to FIG. 2, each pixel 10 includes an organic light emitting diode OLED, and a pixel circuit 12 coupled to the data line Dm and the scan line Sn so as to control the organic light emitting diode OLED.

An anode electrode of the organic light emitting diode OLED is coupled to the pixel circuit 12, and a cathode electrode of the organic light emitting diode OLED is coupled to the second voltage ELVSS.

The organic light emitting diode OLED generates light with a luminance (e.g., a predetermined luminance) corresponding to current supplied from the pixel circuit 12.

The pixel circuit 12 controls the amount of current supplied to the organic light emitting diode OLED, corresponding to a data signal supplied to the data line Dm when a scan signal is supplied to the scan line Sn. To this end, the pixel circuit 12 includes a second transistor T2 coupled between the first voltage ELVDD and the organic light emitting diode OLED, a first transistor T1 coupled between the second transistor T2, the data line Dm and the scan line Sn, and a storage capacitor Cst coupled between a gate electrode and a first electrode of the second transistor T2.

A gate electrode of the first transistor T1 is coupled to the scan line Sn, and a first electrode of the first transistor T1 is coupled to the data line Dm.

A second electrode of the first transistor T1 is coupled to one terminal of the storage capacitor Cst.

Here, the first electrode is set as any one of source and drain electrodes, and the second electrode is set as an electrode different from the first electrode. For example, when the first electrode is set as a source electrode, the second electrode is set as a drain electrode.

The first transistor T1 coupled to the scan line Sn and the data line Dm is turned on when the scan signal is supplied to the scan line Sn so as to supply the data signal supplied from the data line Dm to the storage capacitor Cst. In this case, the storage capacitor Cst is charged with a voltage corresponding to the data signal.

The gate electrode of the second transistor T2 is coupled to the one terminal of the storage capacitor Cst, and the first electrode of the second transistor T2 is coupled to the other terminal of the storage capacitor Cst and the first voltage ELVDD. A second electrode of the second transistor T2 is coupled to the anode electrode of the organic light emitting diode OLED.

The second transistor T2 controls the amount of current flowing from the first voltage ELVDD to the second voltage ELVSS via the organic light emitting diode OLED, corresponding to the voltage stored in the storage capacitor Cst. In this case, the organic light emitting diode OLED generates light corresponding to the amount of the current supplied from the second transistor T2.

The pixel structure of FIG. 2 described above is merely one embodiment of the present invention, and therefore, the pixel 10 of embodiments of the present invention is not limited thereto. In embodiments of the present invention, the pixel circuit 12 has a circuit structure in which current may be supplied to the organic light emitting diode OLED, and may be selected as any one of various structures currently known in the art.

Figure 3:
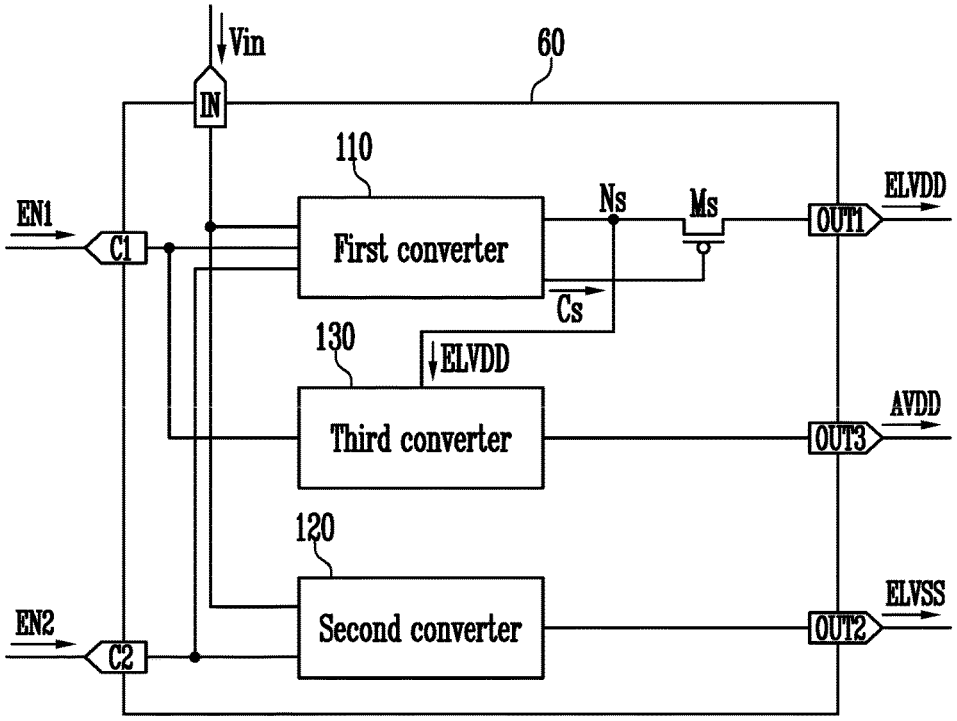
FIGS. 3 and 4 are schematic circuit diagrams illustrating a power supplier according to an embodiment of the present invention.
Figure 4:
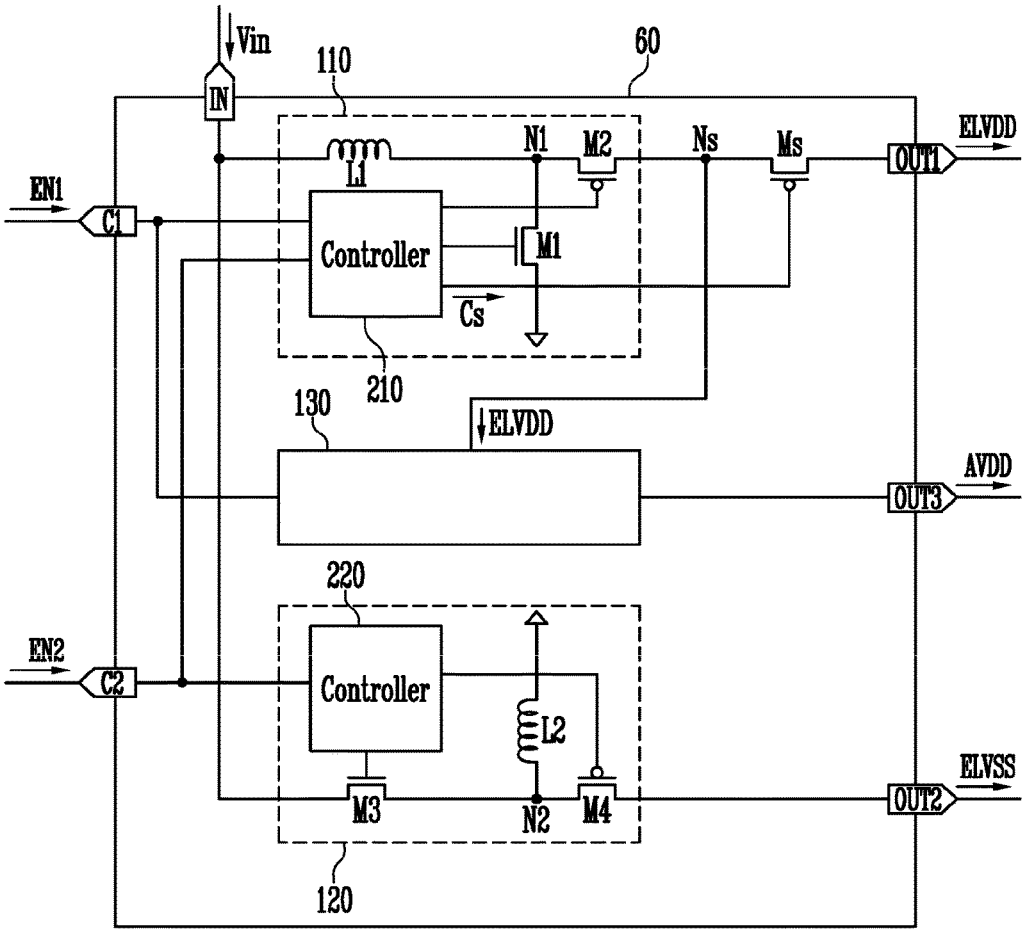

FIGS. 3 and 4 are circuit diagrams illustrating a power supplier according to an embodiment of the present invention. Particularly, the circuit configuration of first and second converters 110 and 120 are illustrated in detail in FIG. 4.

Referring to FIGS. 3 and 4, the power supply unit 60 according to this embodiment may include a first converter 110, a second converter 120, a third converter 130 and a shutdown switch Ms.

The first converter 110 may convert the input voltage Vin supplied through an input terminal IN into the first voltage ELVDD.

For example, the first converter 110 may be a DC-DC converter that generates the first voltage ELVDD by boosting the input voltage Vin.

In this case, whether the first voltage ELVDD generated in the first converter 110 is to be supplied to the pixels 10 may be determined by the shutdown switch Ms.

The shutdown switch Ms performs a function to control whether or not the first voltage ELVDD generated in the first converter 110 is supplied to the pixels 10.

For example, in a case where the shutdown switch Ms is turned on, the first voltage ELVDD output from the first converter 110 is provided to a first output terminal OUT1 through the shutdown switch Ms. The first voltage ELVDD output from the first output terminal OUT1 is supplied to the pixels 10.

In a case where the shutdown switch Ms is turned off, the first voltage ELVDD output from the first converter 110 is not provided to the first output terminal OUT1. Therefore, the first voltage ELVDD is not supplied to the pixels 10.

To this end, the shutdown switch Ms may be coupled between an output terminal Ns of the first converter 110 and the first output terminal OUT1 of the power supply unit 60.

The on-off operations of the shutdown switch Ms may be controlled by a switching control signal Cs supplied from the first converter 110.

For example, the shutdown switch Ms may be implemented as a transistor.

The voltage level of the first output terminal OUT1 is rapidly changed at a time when the shutdown switch Ms is turned on or turned off, and therefore, an abnormality of image quality may be caused.

Thus, according to embodiments of the present invention, the pixels 10 may display black during a specific period including the time when the shutdown switch Ms is turned on and the time when the shutdown switch Ms is turned off.

In embodiments of the present invention, the pixels 10 normally emit light within the period when the shutdown switch Ms is maintained in a turn-on state for a certain period of time.

The second converter 120 may convert the input voltage Vin supplied through the input terminal IN into the second voltage ELVSS.

For example, the second converter 120 may be a DC-DC converter that generates the second voltage ELVSS by inverting the input voltage Vin.

In this case, the second voltage ELVSS output from the second converter 120 may be provided to the pixels 10 through a second output terminal OUT2.

The third converter 130 may convert the first voltage ELVDD supplied from the first converter 110 into the third voltage AVDD.

For example, the third converter 130 may be a DC-DC converter that generates the third voltage AVDD by boosting the first voltage ELVDD.

In this case, the third voltage AVDD output from the third converter 130 may be provided to the scan driver 30 and/or the data driver 40 through a third output terminal OUT3.

Particularly, the third converter 130 does not use the input voltage Vin but uses the first voltage ELVDD, thereby increasing (or improving) voltage conversion efficiency.

A first control signal EN1 may be supplied to a first control terminal C1 of the power supply unit 60, and a second control signal EN2 may be supplied to a second control terminal C2 of the power supply unit 60.

The presence of driving of the first and third converters 110 and 130 may be determined by the first control signal EN1.

For example, the driving of the first and third converters 110 and 130 may be started corresponding to the supply of the first control signal EN1.

In this case, the third converter 130 uses the first voltage ELVDD generated in the first converter 110, and hence the driving of the third converter 130 may be started later than that of the first converter 110.

In a case where the supply of the first control signal EN1 is stopped, the driving of the first and third converters 110 and 130 may be finished.

The presence of driving of the second converter 120 may be determined by the second control signal EN2.

For example, the driving of the second converter 120 may be started corresponding to the supply of the second control signal EN2.

In a case where the supply of the second control signal EN2 is stopped, the driving of the second converter 120 may be finished.

The voltage level of the second output terminal OUT2 is rapidly changed at a time when the second converter 120 is driven or a time when the driving of the second converter 120 is finished, and therefore, the abnormality of image quality may be caused.

Thus, the pixels 10 may display black during a specific period including the period in which the level of the second voltage ELVSS is changed.

Referring to FIG. 4, the first converter 110 may include a first inductor L1, a first switching element M1, a second switching element M2 and a first controller 210.

The first inductor L1 may be coupled between a first node N1 and the input terminal IN to which the input voltage Vin is applied.

The first switching element M1 may be coupled between the first node N1 and a ground.

The second switching element M2 may be coupled between the first node N1 and an output terminal Ns.

The shutdown switch Ms may be coupled between the output terminal Ns and the first output terminal OUT1 to which the first voltage ELVDD is output.

Thus, the shutdown switch Ms may be coupled between the second switching element M2 and the first output terminal OUT1.

In this case, the first node N1 may be defined as a common node of the first inductor L1, the first switching element M1 and the second switching element M2.

The first controller 210 may control the first and second switching elements M1 and M2, corresponding to the first control signal EN1.

For example, the first controller 210 controls on-off operations of the first and second switching elements M1 and M2, so as to convert the input voltage Vin into the first voltage ELVDD having a certain voltage level (e.g., a desired voltage level).

The first controller 210 may control the shutdown switch Ms, corresponding to the second control signal EN2.

For example, in a case where the second control signal EN2 is supplied, the first controller 210 supplies the switching control signal Cs to the shutdown switch Ms, so as to turn on the shutdown switch Ms.

In a case where the supply of the second control signal EN2 is stopped, the first controller 210 may turn off the shutdown switch Ms.

In this case, the first and second switching elements M1 and M2 may be alternately turned on.

The first and second switching elements M1 and M2 may be implemented as transistors.

The first and second switching elements M1 and M2 may be implemented as transistors having different conductive types for the purpose of convenience of control. For example, in a case where the first switching element M1 is formed as an N-type transistor, the second switching element M2 may be formed as a P-type transistor.

The circuit configuration described above is merely one embodiment of the first converter 110, and therefore, the first converter 110 of embodiments of the present invention may be designed in a manner different from the circuit configuration described above.

Referring to FIG. 4, the second converter 120 may include a third switching element M3, a fourth switching element M4, a second inductor L2 and a second controller 220.

The third switching element M3 may be coupled between a second node N2 and the input terminal IN to which the input voltage Vin is applied.

The fourth switching element M4 may be coupled between the second node N2 and the second output terminal OUT2 to which the second voltage ELVSS is output.

The second inductor L2 may be coupled between the second node N2 and the ground.

In this case, the second node N2 may be defined as a common node of the third switching element M3, the fourth switching element M4 and the second inductor L2.

The second controller 220 may control the third and fourth switching elements M3 and M4, corresponding to the second control signal EN2.

For example, the second controller 220 controls on-off operations of the third and fourth switching elements M3 and M4, so as to convert the input voltage Vin into the second voltage ELVSS having a certain voltage level (e.g., a desired voltage level).

In this case, the third and fourth switching elements M3 and M4 may be alternately turned on.

The third and fourth switching elements M3 and M4 may be implemented as transistors.

The third and fourth switching elements M3 and M4 may be implemented as transistors having different conductive types for the purpose of convenience of control. For example, in a case where the third switching element M3 is formed as an N-type transistor, the fourth switching element M4 may be formed as a P-type transistor.

The circuit configuration described above is merely one embodiment of the second converter 120, and therefore, the second converter 120 of embodiments of the present invention may be designed in a manner different from the circuit configuration described above.

The third converter 130 may generate the third voltage AVDD, using the first voltage ELVDD provided from the output terminal Ns of the first converter 110.

In this case, the third converter 130 may have a circuit configuration identical or similar to the first converter 110 described above in order to perform a boosting operation of the first voltage ELVDD.

Figure 5:
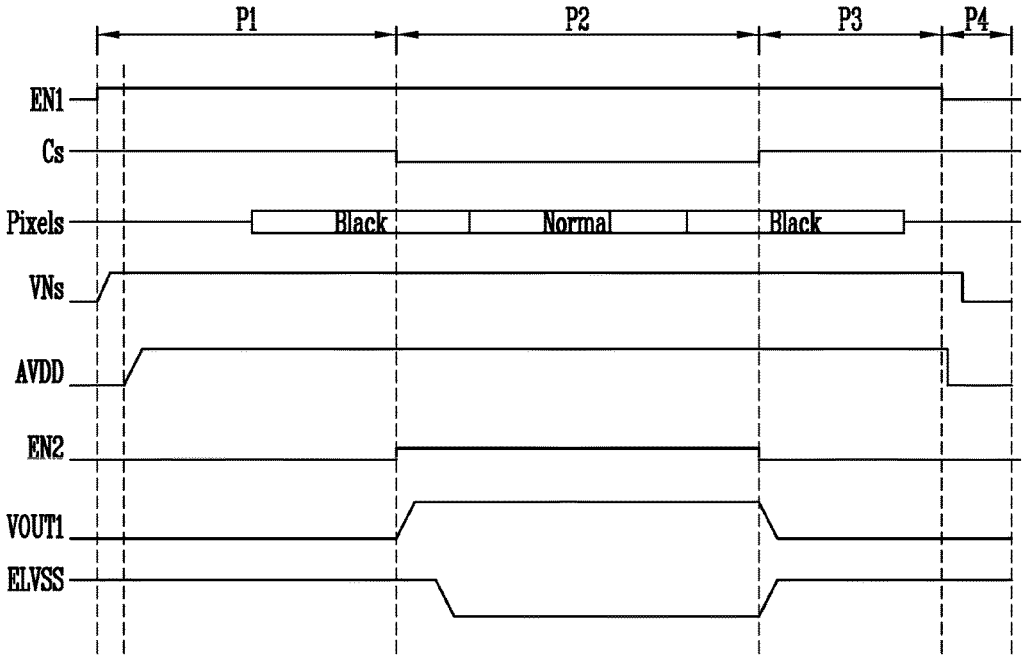
FIG. 5 is a waveform diagram illustrating a driving method of an organic light emitting display according to an embodiment of the present invention.

FIG. 5 is a waveform diagram illustrating a driving method of an organic light emitting display according to an embodiment of the present invention.

Referring to FIG. 5, the driving method according to this embodiment may be performed in the order of a first period P1, a second period P2, a third period P3 and a fourth period P4.

During the first period P1, the input voltage Vin is converted into the first voltage ELVDD by driving the first converter 110, and the first voltage ELVDD is converted into the third voltage AVDD by driving the third converter 130.

In this case, the third voltage AVDD output from the third converter 130 may be supplied to at least one of the scan driver 30 and the data driver 40.

For example, the driving of the first converter 110 may be started corresponding to the first control signal EN1.

Accordingly, the voltage VNs at the output terminal of the first converter 110 may be increased and then maintained as a constant voltage level.

However, during the first period P1, the shutdown switch Ms is maintained in a turn-off state by the switching control signal Cs.

Thus, the voltage VNs at the output terminal of the first converter 110 is not provided to the first output terminal OUT1 of the power supply unit 60.

As a result, the first voltage ELVDD generated in the first converter 110 is not provided to the pixels 10 during the first period P1.

The driving of the third converter 130 may be started corresponding to the supply of the first control signal EN1.

In this case, the third converter 130 receives the first voltage ELVDD supplied from the first converter 110, and therefore, the driving of the third converter 130 may be started later than that of the first converter 110.

During the second period P2, the shutdown switch Ms is turned on to supply the first voltage ELVDD generated in the first converter 110 to the pixels 10, and the second converter 120 is driven to convert the input voltage Vin into the second voltage ELVSS and to supply the converted second voltage ELVSS to the pixels 10.

For example, a low-level switching control signal Cs is supplied to the shutdown switch Ms, corresponding to the supply of the second control signal EN2, so that the shutdown switch Ms may be maintained in the turn-on state during the second period P2.

Thus, the first voltage ELVDD generated in the first converter 110 may be output to the first output terminal OUT1 through the turned-on shutdown switch Ms, and the first voltage ELVDD output from the first output terminal OUT1 may be supplied to the pixels 10.

Referring to FIG. 5, it may be seen that the voltage VOUT1 at the first output terminal of the power supply unit 60 becomes equal to the voltage VNs at the output terminal of the first converter 110.

However, the voltage VOUT1 at the first output terminal of the power supply unit 60 is rapidly changed at the time when the shutdown switch Ms is turned on, and therefore, the abnormality of image quality may be caused.

Thus, the pixels 10 preferably display black during a specific period including the time when the shutdown switch Ms is turned on.

For example, the driving of the second converter 120 may be started corresponding to the supply of the second control signal EN2.

The second voltage ELVSS output from the second converter 120 may be supplied to the pixels 10.

However, the level of the second voltage ELVSS is rapidly changed at the time when the second converter 120 is driven, and therefore, the abnormality of image quality may be caused.

Thus, the pixels 10 may display black during a specific period including the period in which the level of the second voltage ELVSS is changed.

The first and second voltages ELVDD and ELVSS are supplied to the pixels 10 for the purpose of normal emission of the pixels 10.

Thus, the pixels 10 may perform a normal emission operation within the second period P2 in which the first and second voltages ELVDD and ELVSS are normally supplied.

For example, the pixels 10 may perform the normal emission operation within the period in which the shutdown switch Ms is maintained in the turn-on state so that the first voltage ELVDD is supplied to the pixels 10.

The supply of the first control signal EN1 is continued during the second period P2, and accordingly, the driving of the first and third converters 110 and 130 may be continued.

During the third period, the shutdown switch Ms is turned off to block the first voltage ELVDD generated in the first converter 110 from being supplied to the pixels 10 and to stop the driving of the second converter 120.

For example, a high-level switching control signal Cs is supplied to the shutdown switch Ms, so that the shutdown switch Ms may be maintained in the turn-off state during the third period P3.

Thus, the voltage VOUT1 at the first terminal of the power supply unit 60 is dropped, unlike the voltage VNs at the output terminal of the first converter 110.

However, the voltage VOUT1 at the first output terminal of the power supply unit 60 is rapidly changed at the time when the shutdown switch Ms is turned off, and therefore, the abnormality of image quality may be caused.

Thus, the pixels 10 may display black during a specific period including the time when the shutdown switch Ms is turned off.

For example, the driving of the second converter 120 may be stopped corresponding to the stopping of the supply of the second control signal EN2.

However, the level of the second voltage ELVSS is rapidly changed at the time when the driving of the second converter 120 is finished, and therefore the abnormality of image quality may be caused.

Thus, the pixels 10 may display black during a specific period including the period in which the level of the second voltage ELVSS is changed.

During the fourth period P4, the driving of the first and third converters 110 and 130 may be stopped.

For example, the driving of the first and third converters 110 and 130 may be finished corresponding to the stopping of the supply of the first control signal EN1.

Thus, the voltage VNs at the output terminal of the first converter 110 and the third voltage AVDD of the third converter 130 are dropped.

In order to reduce (or prevent) circuit damage of the third converter 130, the driving of the first converter 110 may be finished after the driving of the third converter 130 is finished.

By way of summation and review, an organic light emitting display includes a power supply unit that generates and supplies voltages to drive the organic light emitting display by converting an external voltage.

As the organic light emitting display is employed in a mobile device, etc., interest in voltage conversion efficiency of the power supply unit is increased.

As the level of a voltage output from the power supply unit is rapidly changed, the abnormality of image quality may be caused.

As described above, according to embodiments of the present invention, it is possible that an organic light emitting display and a driving method thereof may increase (or improve) voltage conversion efficiency and reduce (or prevent) the abnormality of image quality.

Example embodiments have been disclosed herein, and although specific terms are employed, they are used and are to be interpreted in a generic and descriptive sense only and not for purpose of limitation. In some instances, as would be apparent to one of ordinary skill in the art at the time of invention, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims, and equivalents thereof.

What is claimed is:

1. An organic light emitting display comprising:

a plurality of pixels coupled to scan lines and data lines;

a scan driver configured to supply scan signals to the pixels through the scan lines;

a data driver configured to supply data signals to the pixels through the data lines; and a power supplier configured to supply a first voltage to the pixels and to supply a second voltage to at least one of the scan driver and the data driver, wherein the power supplier comprises a first converter configured to convert an input voltage into the first voltage, and a second converter configured to receive the first voltage generated by the first converter and convert the received first voltage into the second voltage.

2. The organic light emitting display of claim 1, wherein the power supplier further comprises a shutdown switch configured to control whether or not the first voltage generated by the first converter is supplied to the pixels.

3. The organic light emitting display of claim 2, wherein the power supplier is configured to supply a third voltage to the pixels and further comprises a third converter configured to convert the input voltage into the third voltage.

4. The organic light emitting display of claim 3, wherein driving of the first and second converters is controlled by a first control signal.

5. The organic light emitting display of claim 4, wherein driving of the second converter is started after that of the first converter.

6. The organic light emitting display of claim 4, wherein on-off operations of the shutdown switch are controlled by a second control signal.

7. The organic light emitting display of claim 6, wherein driving of the third converter is controlled by the second control signal.

8. The organic light emitting display of claim 3, wherein the pixels display black during a period when a level of the third voltage output from the third converter is changed.

9. The organic light emitting display of claim 2, wherein the pixels display black during a period when the shutdown switch is turned on and when the shutdown switch is turned off.

10. The organic light emitting display of claim 2, wherein the pixels perform a normal emission operation within a period in which the shutdown switch is in a turn-on state.

11. The organic light emitting display of claim 3, wherein the first voltage is a positive voltage, and the third voltage is a negative voltage.

12. The organic light emitting display of claim 1, wherein the second voltage has a level higher than that of the first voltage.

* * * * *